US006398624B1

(12) United States Patent
Izumi et al.

(10) Patent No.: US 6,398,624 B1
(45) Date of Patent: Jun. 4, 2002

(54) METHOD OF FLATTENING A SURFACE OF A SEMICONDUCTOR FILM

(75) Inventors: Yoshihiro Izumi, Kashihara; Osamu Teranuma, Tenri, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/534,050

(22) Filed: Mar. 24, 2000

(30) Foreign Application Priority Data

Apr. 19, 1999 (JP) ..... 11-111239

(51) Int. Cl.[7] ..... B24B 1/00
(52) U.S. Cl. ..... 451/38; 451/60
(58) Field of Search ..... 451/28, 36, 37, 451/38, 60, 287, 288, 39, 40; 51/410, 322, 319–321

(56) References Cited

U.S. PATENT DOCUMENTS 5,025,597 A * 6/1991 Tada et al. ..... 451/75
5,379,336 A 1/1995 Kramer et al.

FOREIGN PATENT DOCUMENTS

| | | |
|---|---|---|
| EP | 0 523 783 A | 1/1993 |
| EP | 0 602 475 A | 6/1994 |
| EP | 0 783 177 A | 7/1997 |
| JP | 6-342098 A | 12/1994 |

OTHER PUBLICATIONS

Ohyama et al, "High Efficient Thin–Film Cds/CdTe Solar Cells", Matsushita Technical Journal, vol. 55, No. 4, Aug. 1998, pp. 477–480.

Baba, "CdTe Radiation Detectors and their Recent Development", Applied Physics, vol. 65, No. 10, 1996, pp. 1047–1051.

U.S. Ser. No. 09/229,269 filed Jan. 13, 1999, entitled "Two–Dimensional Image Detector and Process for Manufacturing the Same".

U.S. Ser. No. 09/239,855, filed Jan. 29, 1999, entitled " Two–Dimensional Image Detecting Device and Manufacturing Method Thereof".

U.S. Ser. No. 09/543,673, filed Apr. 6, 2000, entitled: Method for Fabricating Detection Element and Method for Fabricating Two–Dimensional Image Detector Using Detection Element.

Lee et al, "A New Digital Detector for Projection Radiography", 1995, SPIE, vol. 2432, pp. 237–249. .

Jeromine et al, "Application of a–Si Active Matrix Technology in a X–Ray Detector Panel", SID 97 Digest, May 13–15, 1997, pp. 91–94.

* cited by examiner

*Primary Examiner*—Derris H. Banks
(74) *Attorney, Agent, or Firm*—Nixon & Vanderhye P.C.

(57) ABSTRACT

A surface of a semiconductor film formed on the substantial entirety of a substrate is bombarded with ceramic particles blasted by an abrasive particle discharge nozzle. The abrasive particle discharge nozzle blasts the abrasive ceramic particles while repeating its reciprocal movement along the X-axis at a constat cycle and high velocity. In a flattening step, the substrate is moved relative to the abrasive particle discharge nozzle along the Y-axis so that the entire surface of the semiconductor film is bombarded with the ceramic particles. Thus, a method is offered to readily flatten an irregular surface of a semiconductor film.

13 Claims, 6 Drawing Sheets

METHOD OF FLATTENING A SURFACE OF A SEMICONDUCTOR FILM

FIELD OF THE INVENTION

The present invention relates to a method of flattening a surface of a semiconductor film formed by various film forming techniques, such as CVD (Chemical Vapor Deposition), PVD (Physical Vapor Deposition), paste printing, and burning.

BACKGROUND OF THE INVENTION

Conventionally well-known semiconductor materials that are highly sensitive to x-rays and other kinds of radiation include CdTe and CdZnTe as described in "CdTe Radiation Detector And Its Recent Developments" (Applied Physics, Vol 65. No. 10, pp.1047–1051, issued in October 1996), for example. Also, in some cases, CdTe is used in CdS/CdTe thin film photovoltaic cells as described in "Matsushita Giho" (Matsushita Technical Journal Vol.44 No.4 pp.477–480 issued in August 1998).

To manufacture a radiation detector element or a photovoltaic cell that incorporates a large substrate, using the aforementioned semiconductor materials, a polycrystalline film needs to be formed of CdTe, CdZnTe, etc. on a substrate made of, for example, glass by MOCVD (Metal Organic Chemical Vapor Deposition), proximate sublimation, paste printing, burning, or other techniques.

However, it is known that the surface of a thick polycrystalline CdTe or CdZnTe film formed by these techniques has irregularities developing from crystal particles in a random manner. The phenomenon is observed when a film is formed of CdTe, CdZnTe, etc. regardless of which film forming technique is used of MOCVD, proximate sublimation, paste printing, or burning.

The irregularity on the film surface can, of course, be reduced by controlling the size of crystals through optimization of film forming conditions, but only to some extent: if a film needs to be formed in a thickness of several hundred $\mu$m, it is difficult to restrain the irregularity on the film surface to a several $\mu$m or lower level. Especially, when the polycrystalline CdTe or CdznTe film is used in an x-ray detector element, since the film needs to be 100 $\mu$m thick or even thicker with the absorption efficiency of x-rays taken into consideration, the development of the foregoing irregularity is inevitable.

As in the foregoing, those irregularities of a magnitude of several $\mu$m that develop on the surface of a semiconductor film after the formation of the film are a cause for various problems; for example, an electric charge inhibition layer formed on the semiconductor film can only insufficiently establish a junction to the semiconductor film at the interface of the two, and therefore fails to inhibit electric charges in a desirable manner, or it becomes difficult to perform fine fabrication on a electric charge inhibition layer and electrode layer formed on the surface of a semiconductor film. These problems make it difficult to manufacture radiation detector elements (e.g., two-dimensional image detectors) and light detector elements (e.g., photovoltaic cells) with satisfactory levels in performance and reliability.

SUMMARY OF THE INVENTION

The present invention has an object to offer a method of flattening a surface of a semiconductor film by easily eliminating irregularities from the surface of a semiconductor film.

In order to achieve the object, the method of flattening a surface of a semiconductor film in accordance with the present invention is characterized in that it includes the step of bombarding an irregular surface of a semiconductor film with abrasive particles so as to grind the irregular surface.

Irregularities are found in some cases on the surface of a semiconductor film just formed because the crystal particles constituting the semiconductor film are present on the surface in a random manner. That irregular semiconductor film, if used as it is in a radiation detector element, fails to deliver satisfactory performance and reliability; therefore, such irregularity should be minimized.

To achieve the task, conventionally, conditions are optimized in the formation of a semiconductor film, so as to control the crystal particles in terms of their diameters and eventually to reduce the irregularity. The conventional method successfully reduces the irregularity, but only to some extent: the dimensions of irregularities are still larger than the diameters of crystal particles. This is not practical for realization of a higher level of fine fabrication.

Meanwhile, the irregular surface of a semiconductor film processed by the foregoing method in accordance with the present invention is flattened as it is ground by bombarding abrasive particles. Since the surface of a semiconductor film is flattened through grinding, the dimensions of irregularities are readily reduced below the diameters of the crystal particles constituting the semiconductor film, and possibly to minimum levels. Further, only a simple device is required to bombard a semiconductor film with abrasive particles; therefore, the foregoing method of flattening can be incorporated in the manufacture of radiation detector elements and the like at small cost, and imparts increased reliability to the radiation detector elements manufactured.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a photographical drawing, obtained from a microscopic observation of the surface of the semiconductor film.

FIG. 3(*b*) is a photographical drawing, obtained from a microscopic observation of the surface of the semiconductor film.

DESCRIPTION OF THE EMBODIMENT

Figure 1A:
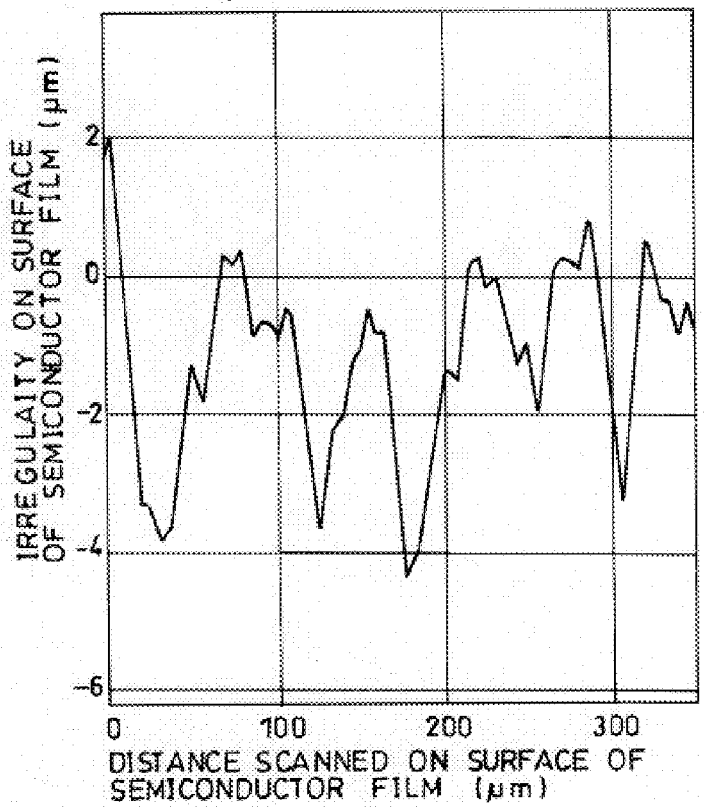
FIG. 1(*a*) is a graph showing data representative of the shapes of irregularities on a surface of a semiconductor film right after the film is formed.
Figure 1B:
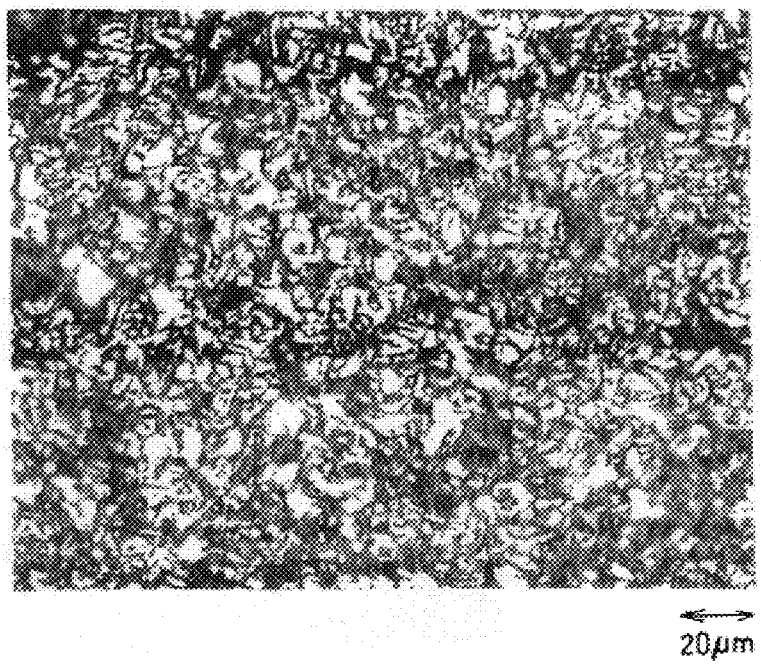
Figure 3A:
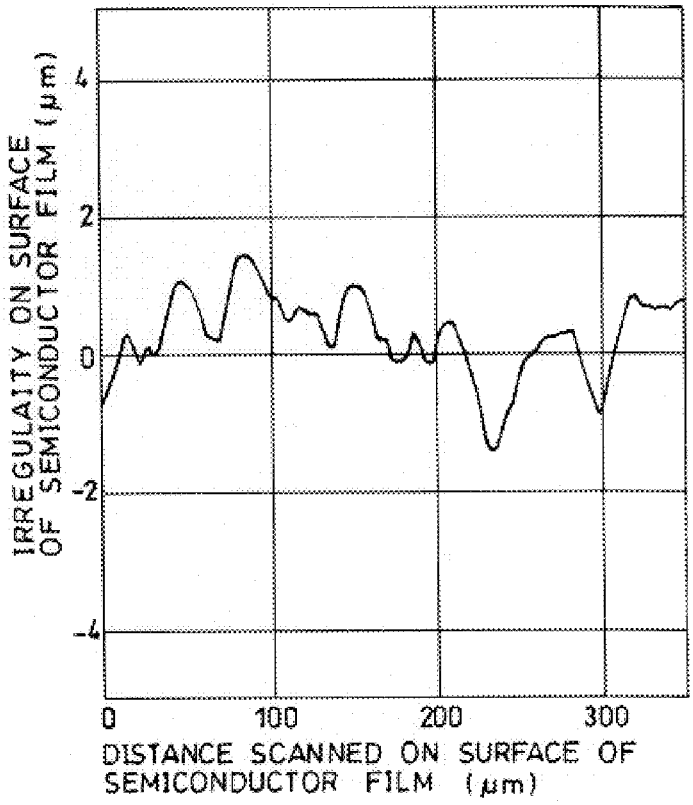
FIG. 3(*a*) is a graph showing data representative of the shapes of irregularities on a surface of a semiconductor film after the surface has undergone a flattening step in accordance with the method.
Figure 3B:
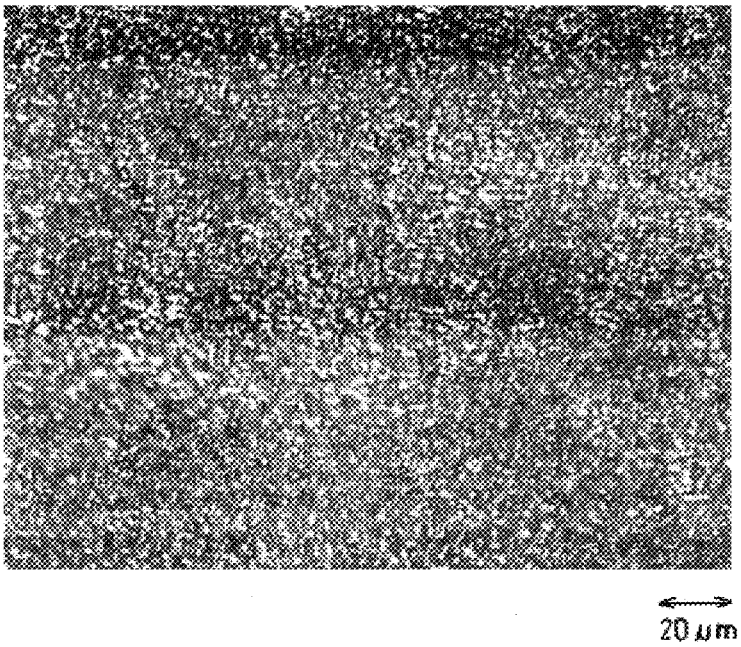

Referring to FIG. 1(*a*) and FIG. 1(*b*) through FIG. 3(*a*) and FIG. 3(*b*), the following description will discuss an embodiment of the present invention.

Typically, a polycrystalline semiconductor film of CdTe, CdZnTe, etc. can be formed by various methods including MOCVD (Metal organic Chemical Vapor Deposition), proximate sublimation, paste printing, and burning. However, if the semiconductor film is formed in a thickens of several hundred μm, numerous irregularities develop across a film surface so that the difference in elevation level between the highest and lowest points is as large as several μm.

FIG. 1(*a*) is a graph showing data representative of the shapes of irregularities on a surface of a semiconductor film right after the film is formed of CdTe by an MOCVD technique. FIG. 1(*b*) is a microscopic photograph of the semiconductor film surface. The data shown in FIG. 1(*a*) shows that irregularities developing on the surface have differences in elevation level between their highest and lowest points which are as large as 4 μm to 5 μm. As can be observed from the microscopic photograph shown in FIG. 1(*b*), the irregularity of the semiconductor film surface is presumably caused by CdTe crystal particles of several μm in diameters existing in a random manner on the semiconductor film surface.

Note that the film is formed here using an MOCVD technique; however, there are other film formation methods available, including proximate sublimation, paste printing, and burning, whereby a semiconductor film is formed with its surface having irregularities similarly to the foregoing.

Figure 2:
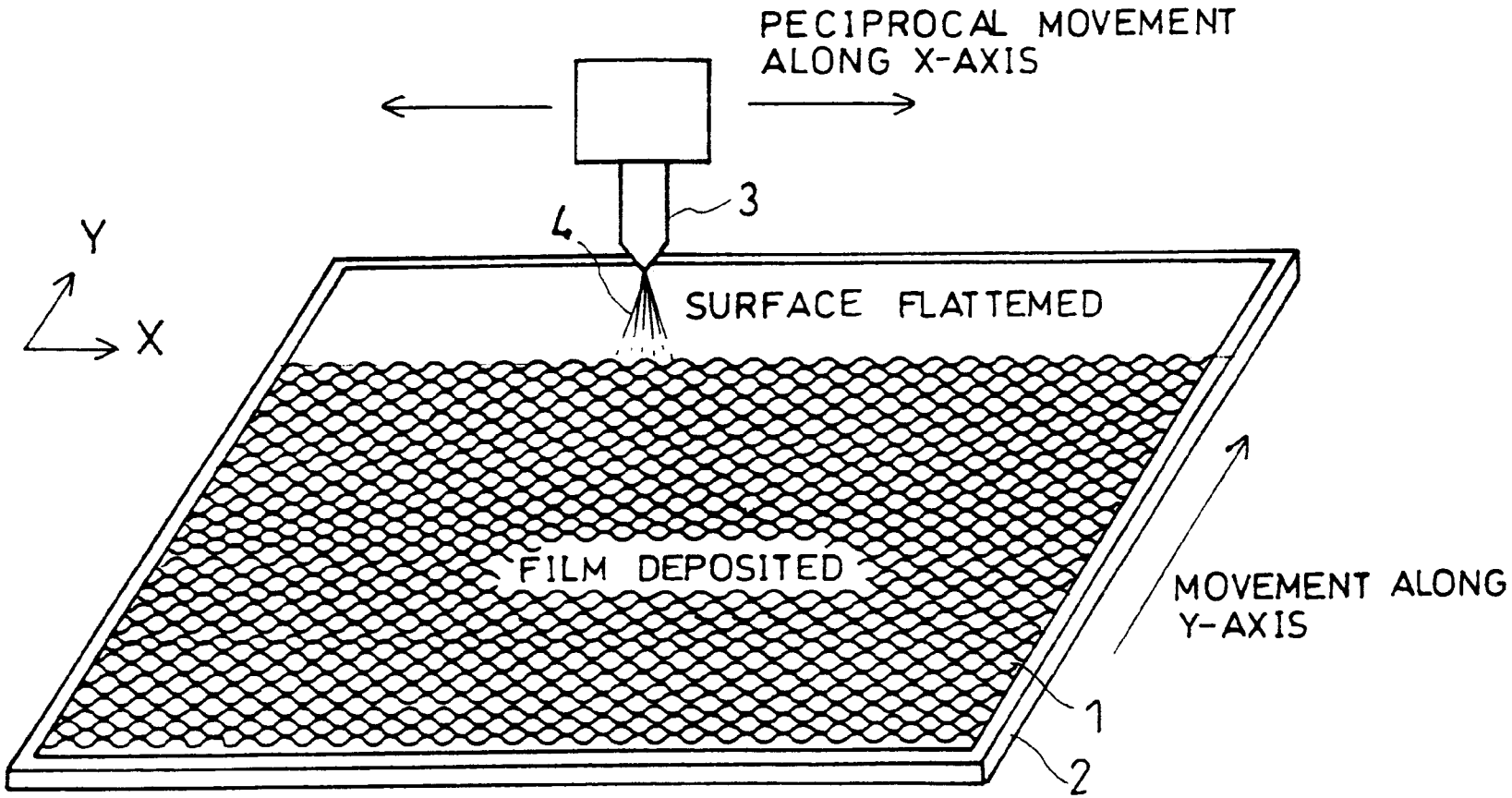
FIG. 2 is an explanatory drawing illustrating a method of flattening a surface of a semiconductor film, which is an embodiment in accordance with the present invention.

Accordingly, in the present embodiment, as shown in FIG. 2, the surface of a semiconductor film 1 just formed is bombarded with ceramic particles (abrasive particles) 4 to flatten the surface of the semiconductor film 1. So, the method of flattening a surface of a semiconductor film in accordance with the present embodiment includes the step of bombarding the irregular surface of the semiconductor film 1 with the ceramic particles 4 so as to grind the surface of the semiconductor film 1.

As shown in FIG. 2, the surface of the semiconductor film 1 formed almost across a substrate 2 is bombarded with the ceramic particles 4 blasted by an abrasive particle discharge nozzle 3. The abrasive particle discharge nozzle 3 blasts the ceramic particles 4 while moving at a high velocity along the X-axis reciprocally at a certain cycle. As the substrate 2 is moved relative to the abrasive particle discharge nozzle 3 along the Y-axis, the entire surface of the semiconductor film 1 is bombarded with the ceramic particles 4 and thereby flattened.

The aforementioned method of flattening a surface of a semiconductor film involves nothing more than bombarding the surface of the semiconductor film 1 with the ceramic particles 4. The method is therefore very simple and advantageous in its sufficient applicability with a semiconductor film formed on a very large substrate.

After finishing the foregoing flattening process of the entire surface of the semiconductor film 1, the ceramic particles 4 and ground particles that are adhering to the surface of the semiconductor film 1 are completely washed out with an organic solvent or by ultrasonic cleaning using pure water.

Table 1 below shows various processing conditions under which the method of flattening a surface of a semiconductor film in accordance with the present embodiment is conducted.

TABLE 1

| | |
|---|---|
| Type of Particles | $Al_2O_3$ |
| Diameters of Particles | #2000 |
| Velocity of Substrate | 200 mm/min |
| Air Pressure | 5 kg/cm$^2$ |
| Velocity of Nozzle | 20 m/min |
| Distance Between Nozzle and Substrate | 30 mm |
| Repetition | 5 times |

FIG. 1(*a*) and FIG. 1(*b*) are a graph showing data representative of the shapes of irregularities on the surface of a semiconductor film and a microscopic photograph of the surface respectively, right after the film is formed. By contrast, FIG. 3(*a*) and FIG. 3(*b*) are a graph showing data representative of the shapes of irregularities on the surface of the semiconductor film 1 and a microscopic photograph of the surface of the semiconductor film 1 respectively, after the surface is flattened by the aforementioned method.

It is confirmed from the data shown in FIG. 3(*a*) that the flattening of the surface of the semiconductor film 1 by the method shown in FIG. 2 has reduced the difference in elevation level between the concave and convex portions of the irregular surface from a pre-process value of 4 μm to 5 μm to a post-process value of 1 μm to 2 μm. This is presumably because the abrasive ceramic particles 4 blasted onto the surface of the semiconductor film 1 clip (the tops of) the convex portions of the irregularity, on the surface of the semiconductor film 1, thereby flattening the surface of the semiconductor film 1.

Further, the ceramic particles 4 are varied in size so as to confirm the advantages of the flattening through the bombardment with the ceramic particles 4. As a result, it is found out that ceramic particles 4 having diameters of #1000 to #4000 produce desirable results with the surface of the semiconductor film 1 having such irregularities that the difference in elevation level is from 4 μm to 5 μm. Using ceramic particles 4 of diameters within this range will effectively flatten the surface of the semiconductor film 1. Incidentally, the sign, "#", represents a unit expressing sizes of meshes by means of the number of perforations per inch.

Further, if the surface of the semiconductor film 1 is so irregular that the differences in elevation level between concave and convex portions are large as 10 μm or even larger, as a preparation for an actual flattening process, the surface of the semiconductor film 1 is ground in a rough manner using particles of #1000 in diameter. Subsequently, the flattening process is performed through the bombardment with ceramic particles of #3000 in diameter as described in the foregoing.

In other words, the surface of the semiconductor film 1 is ground in advance using particles of larger diameters than the ceramic particles 4 used later in the flattening process. Hence, the surface of the semiconductor film 1, even if it is highly irregular, can be efficiently and surely flattened.

These methods enable the surface of the semiconductor film 1 to be readily flattened and made smooth, despite a possibly high degree of irregularity of the surface, that is, large differences in elevation level between the concave and convex portions of the irregular surface of the semiconductor film 1.

Incidentally, the method of bombarding the object, i.e., the substrate, with ceramic particles is employed popularly for the formation of irregularities on the surface of the substrate in a random manner, i.e., for the formation of a satin finished surface. The method of flattening a surface of a semiconductor film of the present embodiment is the reverse of this typical use of the method: that is, the surface of the semiconductor film 1 is flattened by bombarding the irregular surface of the semiconductor film 1 with ceramic particles 4 of suitable size in advance.

Therefore, the method of flattening as in the present embodiment is very useful in cases where elaborate flattening, e.g., mirror finish, is unnecessary, and the differences in elevation level between the concave and convex portions of the irregular surface, which serve as an index for irregularity of the processed surface, only need to be 1 $\mu$m after a finishing process. Further, the present method is advantageous in that it is as simple as bombarding the surface of the semiconductor film 1 with ceramic particles 4 and readily adoptable to a large semiconductor film.

Here, the "ceramic particles 4" refer collectively to non-metal particles composed of a solid. Examples of such particles include $Al_2O_3$ and various abrasives such as SiC, $B_4C$, BN, and diamond. The ceramic particles 4 have preferably a higher hardness than the abraded semiconductor film 1 and may be composed of a mixture of various abrasives. Further, the object may be bombarded with water or other solutions in which the ceramic particles 4 are dispersed.

When the ceramic particles 4 has a higher hardness than the semiconductor film 1, the abrasion efficiency is increased, and less time is required for the bombardment process. If the semiconductor film 1 is bombarded with a solution (liquid) in which the ceramic particles 4 are dispersed, the ceramic particles 4 adhere to the semiconductor film 1 in decreased amounts, and therefore the adhering ceramic particles 4 can be washed away relatively quickly.

If the surface of the semiconductor film 1 has peculiar protrusions or, when viewed as an entirety, has a warped shape, the surface is roughly abraded in advance by another abrasion method, and thereafter the surface of the semiconductor film 1 is flattened by the method of flattening in accordance with the present embodiment. Hence, the surface of the semiconductor film 1 can be flattened regardless of the shape of the surface.

EXAMPLES

The following will discuss the method of flattening a surface of a semiconductor film in accordance with the present invention in specific terms. Note that the first and second examples below are exemplary applications of the method of flattening a surface of a semiconductor film detailed in DESCRIPTION OF THE EMBODIMENT above to manufacturing processes of devices.

First Example

Figure 4:
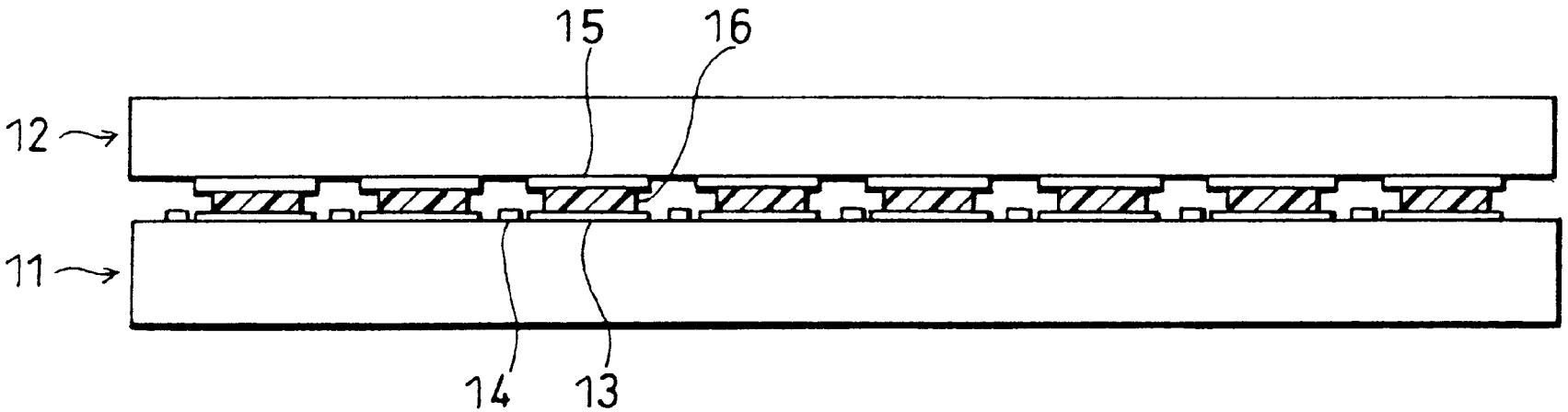
FIG. 4 is a schematic cross-sectional view showing an arrangement of a two-dimensional image detector of a first example in accordance with the present invention.
Figure 5:
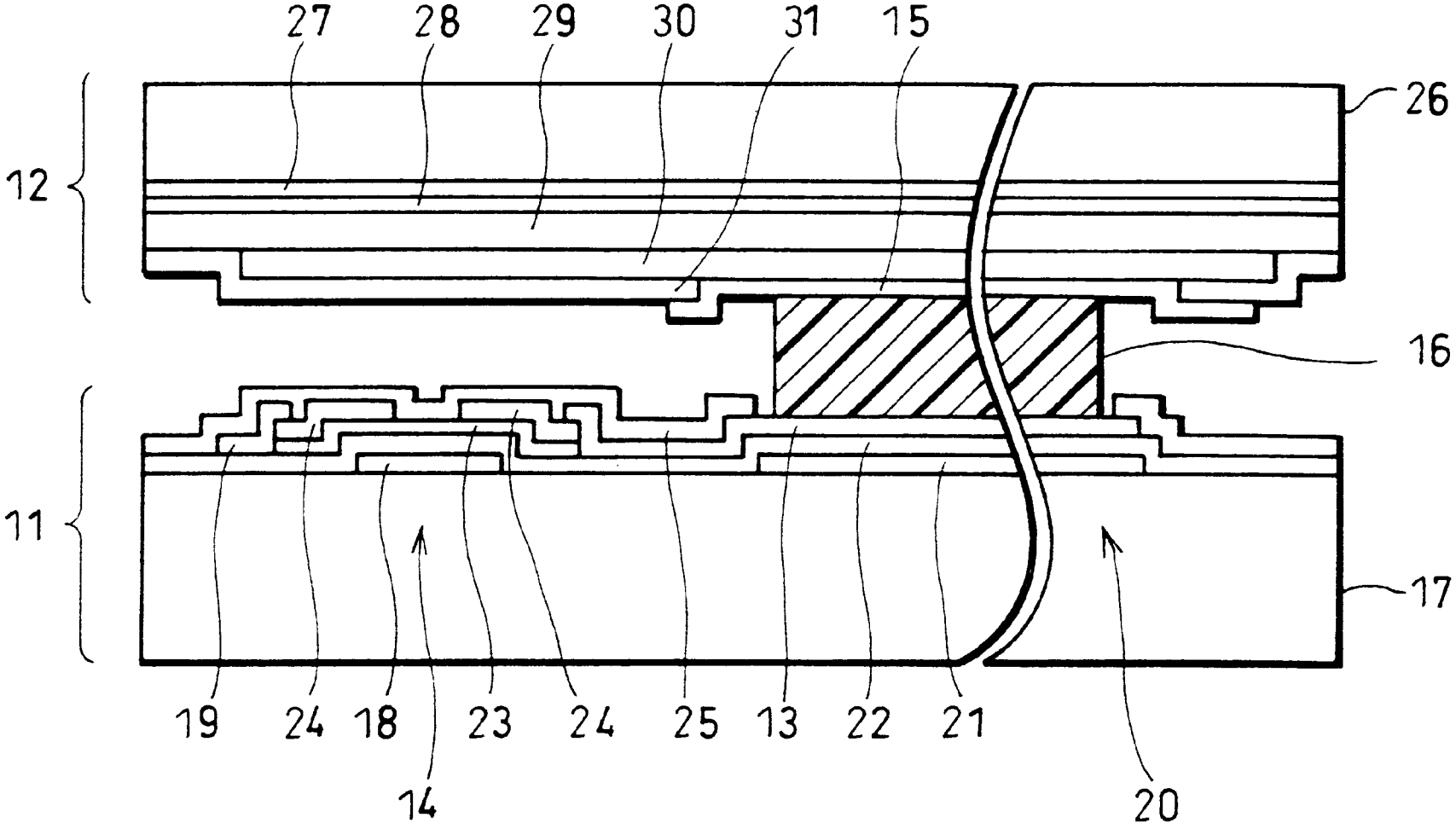
FIG. 5 is a schematic cross-sectional view showing an arrangement of a single pixel in the two-dimensional image detector.

Referring to FIG. 4 and FIG. 5, the following description will discuss the method of flattening a surface of a semiconductor film in accordance with the present invention in relation to its application to the manufacture of a two-dimensional image detector which is a kind of radiation detector element.

FIG. 4 is a cross-sectional view showing an arrangement of a two-dimensional image detector manufactured by the method of flattening a surface of a semiconductor film in accordance with the present example. Note that externally connected circuits, such as a drive circuit and a data retrieval circuit, are omitted in the FIG. 4.

On an active matrix substrate 11, there are provided pixel electrodes 13 each constituting an electric charge storage capacitor (will be explained in detail later), thin film transistors (hereinafter, will be referred to as TFTs) 14, electrode wires (not shown) disposed in a matrix, and other components.

On an opposite substrate 12, there are provided upper electrodes (not shown), a first electric charge inhibition layer disposed as necessary (not shown), a photoconductive semiconductor layer (not shown), a second electric charge inhibition layer disposed as necessary (not shown), and a connection electrode 15, and other components.

The two-dimensional image detector of the present example is constituted by the active matrix substrate 11 and the opposite substrate 12 that are coupled both electrically and mechanically to each other by conductive connecting members 16 disposed in a pattern for respective pixels.

FIG. 5 is a schematic cross-sectional view showing an arrangement of a single pixel in the two-dimensional image detector. The following description will discuss arrangements of the active matrix substrate 11 and the opposite substrate 12 in detail in reference to FIG. 5.

The active matrix substrate 11 of the present example can be fabricated by the same process as is the active matrix substrate fabricated during the course of the manufacture of a liquid crystal display. On a glass substrate 17, there are provided electrode wires (gate electrodes 18 and data electrodes 19) disposed in an X-Y matrix, TFTs 14, and electric charge storage capacitors (Cs) 20, and other components.

The glass substrate 17 is made of a non-alkali glass substrate (e.g., #7059 or #1737 available from Corning Inc.). The gate electrodes 18 composed of a metal film, such as Ta (tantalum), Al(aluminum), or Mo(molybdenum), are disposed on the glass substrate. The gate electrodes 18 are fabricated by forming a metal film in a thickness of about 4000 Å through sputtering vapour deposition and patterning the metal film into a desired pattern. The electric charge storage capacitor electrodes (Cs electrode) 21 constituting the electric charge storage capacitors (Cs) 20 are fabricated at the same time as the fabrication of the gate electrodes 18.

Subsequently, an insulation film 22 of $SiN_x$ (silicon nitrides) or $SiO_x$ (silicon oxides) is deposited in a thickness of about 3500 Å by a CVD technique. The insulation film 22 serves as a dielectric for the gate insulation film and the electric charge storage capacitor (Cs) 20. The insulation film 22 made of $SiN_x$ or $SiO_x$ may be used in combination with an anodized film formed by anodization of the gate electrodes 18 and the electric charge storage capacitor electrodes (Cs electrodes) 21.

Next, an a-Si film (i layer) 23 and an a-Si film ($n^+$layer) 24 are deposited in a thickness of about 1000 Å and 400 Å respectively by a CVD technique and then patterned into desired shapes. The a-Si film (i layer) 23 will serve as a channel section for the TFTs 14. The a-Si film ($n^+$layer) 24 will serve so as to establish connection of the data electrodes 19 and drain electrodes (will be described in detail later) to the a-Si film (i layer) 23.

Subsequently, the data electrodes 19 and pixel electrodes 13 that double as the drain electrodes are fabricated by depositing a metal film, such as Ta, Al, or Ti (titanium), in a thickness of about 4000 Å through sputtering vapour deposition, and then patterning the metal film into desirable shapes. Note that the pixel electrodes 13 and the drain electrodes may be fabricated individually, with the pixel electrodes 13 being fabricated from ITO (Indium Tin Oxide) or similar transparent electrodes.

Thereafter, so as to provide insulation to regions other than the apertures of the pixel electrodes 13, an insulative protection film 25 is formed by depositing a $SiN_x$ or $SiO_x$ insulation film in an thickness of about 6000 Å by a CVD technique and patterning the insulation film into a desired shape. The insulative protection film 25 may be formed from an acrylic, polyimide, or similar organic film, as well as an inorganic film.

This completes the formation of the active matrix substrate 11. Note that the TFTs 14 in the foregoing have an inverted stagger structure using amorphous silicon (a-Si); however, there are alternatives as well. In such an example, polysilicon (a-Si) may be used, and the TFTs 14 may have a stagger structure.

Meanwhile, the opposite substrate 12 is a glass, ceramic, and other x-ray passing substrate and serves as a supporting substrate 26. Here, the opposite substrate 12 is a 0.7 mm to 1.1 mm thick glass substrate that allows passage of a high percentage of both x-rays and visible rays. A high percentage of x-rays in a range of 40 keV to 100 keV can pass through such a glass substrate.

Subsequently, upper electrodes 27 are fabricated on the substantially entire side of the supporting substrate 26 from an ITO, Au (gold), or other similar conductive film. However, when the upper electrodes 27 are incorporated in a two-dimensional image detector for detecting images using visible rays, the upper electrodes 27 need to be formed on ITO that allows passage of visible rays.

Then, a p-type semiconductor layer, as a first electric charge inhibition layer 28, is formed of, for example, ZnTe on the substantial entirety of the upper electrodes 27. A semiconductor layer (semiconductor film) 29 is formed of a photoconductive, i-type semiconductor on the p-type semiconductor layer. The photoconductive semiconductor layer 29 is provided by deposition of a CdTe, CdZnTe, or other polycrystalline film in a thickness of several hundred $\mu$m by a MOCVD technique. Alternatively, the CdTe, CdZnTe, or other polycrystalline film may be formed by proximate sublimation, paste printing, burning, etc. in stead of MOCVD.

In the deposition step above, irregularities grow in a random manner on the surface of the semiconductor layer 29. The irregularity on the surface of the semiconductor layer 29 has substantially the same difference in elevation level as the irregularity on the surface of the semiconductor film shown in FIG. 1(*a*) and FIG. 1(*b*) detailed earlier in DESCRIPTION OF THE EMBODIMENT. Accordingly, under the processing conditions shown in Table 1, the method of flattening a surface of a semiconductor film detailed earlier in DESCRIPTION OF THE EMBODIMENT is applied to the surface of the semiconductor layer 29 so as to flatten the surface of the semiconductor layer 29.

Thereafter, an n-type semiconductor layer is formed of, for example, CdS, as a second electric charge inhibition layer 30. Then, a connection electrode 15 is formed of ITO, Au, Pt (platinum), etc. Here, patterning is performed so that each pixel has its own second electric charge inhibition layer 30 and connection electrode 15 separately from the other pixels; thereby, leak between adjoining pixels can be prevented. The connection electrodes 15 are formed for the purpose of collecting electric charges for the respective pixels. Note that the numerical "31" in the drawing on the opposite substrate 12 represents an insulative protection film.

The opposite substrate 12 as arranged above has an inhibition-type photodiode structure with a PIN junction where the first electric charge inhibition layer (p-type semiconductor layer) 28 and the second electric charge inhibition layer (n-type semiconductor layer) 30 sandwich the photoconductive, i-type semiconductor layer 29. Therefore, the two-dimensional image detector of the present example boasts excellent properties as a sensor, including a reduced dark current when irradiated with no x-ray, and hence an excellent S/N ratio (sensitivity to x-rays).

The provision of the first electric charge inhibition layer 28 and the second electric charge inhibition layer 30 is optional. Further, the first electric charge inhibition layer 28 and the second electric charge inhibition layer 30, if ever provided, may be formed of a different material or materials in a different structure from the foregoing as necessary. For example, alternative structures to a PIN junction include a Schottky junction and an MIS (Metal Insulator Semiconductor) junction. Further, either the first electric charge inhibition layer 28 or the second electric charge inhibition layer 30, or both, may be omitted depending on required properties.

Then, the conductive connecting members 16 are formed through patterning on either one of the active matrix substrate 11 and the opposite substrate 12 prepared in the foregoing steps so that each individual conductive connecting member 16 is provided to a different pixel. Photolithography becomes applicable to the patterning of the conductive connecting members 16 if the conductive connecting members 16 are to be composed of a resin substance prepared by dispersing a conductive pigment in a photosensitive resin.

Thereafter, the substrates are electrically and mechanically coupled as they are subjected to pasting and a high temperature pressurization process, which completes the manufacture of a two-dimensional image detector. The conductive connecting members 16 for coupling the two substrates may be composed of a conductive adhesive agent, instead of the photosensitive resin, which can be patterned through screen printing. Another alternative for the conductive connecting members 16 is bumps composed of a solder.

A further alternative material for the conductive connecting members 16 is a so-called anisotropic conductive adhesive agent prepared by dispersing conductive particles in an adhesive agent (binder resin). The anisotropic conductive adhesive agent per se is anisotropic in its conductive properties; therefore, electrical connection is established between the pixel electrodes 13 of the active matrix substrate 11 and the connection electrodes 15 of the opposite substrate 12, and at the same time, adjoining pixels are sufficiently insulated from each other, without patterning each pixel separately from the other pixels.

The two-dimensional image detector prepared as above includes:

- an active matrix substrate 11 and an opposite substrate 12 electrically and mechanically connected to each other, wherein
  - the active matrix substrate 11 has: electrode wires (gate electrodes 18 and data electrodes 19) disposed in a matrix; TFTs 14 each disposed at respective crossing points of the electrode wires; and pixel electrodes 13 connected to the respective TFTs 14, and
  - the opposite substrate 12 has a photoconductive semiconductor layer 29 on the substantial entirety of its surface.

In the arrangement above, the photoconductive semiconductor layer 29 is not formed directly on the active matrix substrate 11. Therefore, the semiconductor material is readily adoptable in a two-dimensional image detector, even if the semiconductor material is required to be heated to a temperature beyond the thermal resistance of the active matrix substrate 11 in the formation of the photoconductive semiconductor layer 29.

As a result, the semiconductor layer 29 can be formed of a polycrystalline CdTe or CdZnTe film formed at a film formation temperature of, or exceeding, 400° C. by an MOCVD, proximate sublimation, paste printing, burning, or other similar film formation technique. This allows a two-dimensional image detector incorporating the semiconductor layer 29 to have an increased sensitivity to x-rays over a two-dimensional image detector incorporating a semiconductor layer formed of a-Se, and enables the former to collect image data from which video images can be reproduced, i.e., to collect image data at a rate of 33 msec/frame.

The following description will explain advantages of the method of flattening a surface of a semiconductor film of the present example when applied to manufacture of the two-dimensional image detector.

A first advantage is such that the introduction of the process of flattening the surface of the semiconductor layer 29 restricts leaks occurring at the interface of the semiconductor layer 29 and the second electric charge inhibition layer 30.

Specifically, the irregularities on the surface of a conventional semiconductor layer can be a cause for leak currents of several $nA/mm^2$ to flow. However, the introduction of the step of flattening the surface of the semiconductor layer 29 has stabilized leak currents at a reduced level of several tens of $pA/mm^2$.

This greatly increases the S/N ratio and reliability of the sensor.

A second advantage is such that there is less likelihood of bubbles to be trapped between the connection electrodes 15 and the conductive connecting members 16 in the step of combining the active matrix substrate 11 and the opposite substrate 12 via the conductive connecting members 16, and thus, less likelihood of erratic connection and poor reliability.

Specifically, the irregularities of the surface of a conventional semiconductor layer affect the surface of the connection electrode and cause similar irregularities to develop there. However, most of the irregularities disappear as a result of the introduction of the process of flattening the surface of the semiconductor layer. Therefore, in the present example, there is less likelihood of bubbles to be trapped between the connection electrode 15 and the conductive connecting members 16, enabling stable connection to be established. Further, the pattern shape of the conductive connecting members 16 does not vary from pixel to pixel; therefore, adjoining pairs of the conductive connecting members 16 are less likely to come in contact with each other.

Further, since the connection electrode 15 is highly flat, there is less likelihood of erratic connection and poor reliability resulting from conductive connecting members 16 composed of an anisotropic conductive adhesive agent.

A third advantage is such that fine patterning can be performed with better ease so that each pixel has its own connection electrode 15, which is an electrode layer for collecting electric charges, and second electric charge inhibition layer 30, separately from those of the other pixels.

As in the foregoing, the introduction of the method of flattening a surface of a semiconductor film in accordance with the present example to a manufacturing process of a two-dimensional image detector improves the performance and reliability of the two-dimensional image detector.

Second Example

Figure 6:
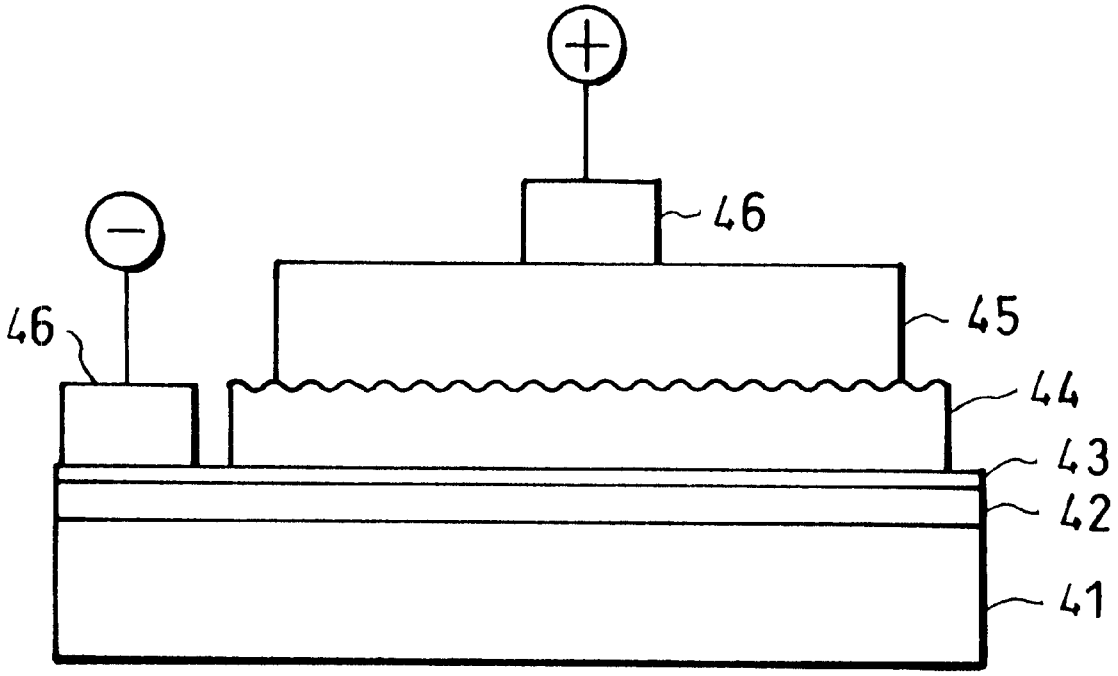
FIG. 6 is a schematic cross-sectional view showing an arrangement of a photovoltaic cell adopting a CdS/CdTe junction, which is a second example in accordance with the present invention.

Referring to FIG. 6, the following description will discuss a method of flattening a surface of a semiconductor film in accordance with the present invention by means of a second example where the method is applied to a device other than the two-dimensional image detector: namely, the method is applied to manufacture of photovoltaic cells which are a kind of light detector element.

FIG. 6 is a cross-sectional view showing a photovoltaic cell adopting a CdS/CdTe junction. A manufacturing process of photovoltaic cells will be explained below in reference to FIG. 6.

To start with, an ITO film, $SnO_2$ film, etc. that will constitute a transparent electrode 42 are formed on a glass substrate 41 (e.g., #1737 available from Corning Inc.).

Next, a CdS thin film 43 is formed in a thickness of about several $\mu$m on the transparent electrode 42 by MOCVD. Then, a CdTe film (semiconductor film) 44 is formed in a thickness of about 10 $\mu$m on the CdS thin film 43 by proximate sublimation. The CdTe crystal particles used here have diameters of about 3 $\mu$m and grow into crystal particles of about half a dozen $\mu$m in diameter by applying a water solution of $CdCl_2$ thereto and subjugating to a heat process of 400° C. for about 15 minutes. In some cases, the crystal particles cause irregularities as large as the diameters of the crystal particles (about 3 $\mu$m) to develop on the surface of the CdTe film 44. Accordingly, in the present example, the CdTe film 44 is subjected to the method of flattening a surface of a semiconductor film discussed in the embodiment so as to flatten the surface of the CdTe film 44.

Table 2 below shows various processing conditions for the method of flattening a surface of a semiconductor film in the present example. The surface of the CdTe semiconductor film 44 is bombarded with ceramic particles under the conditions. It is confirmed that the differences in elevation level between the concave and convex portions of the irregular surface, which have been about 3 $\mu$m before the flattening process, are reduced to about 1 $\mu$m by the flattening process. However, it should be noted that the overall thickness of the CdTe film 44 decreases as it undergoes the flattening process, and attention should be paid in advance in the formation process of the CdTe film 44 to compensate for the decrease.

TABLE 2

| | |
|---|---|
| Type of Particles | SiC |
| Diameters of Particles | #3000 |
| Velocity of Substrate | 200 mm/min |
| Air Pressure | 4 $kg/cm^2$ |
| Velocity of Nozzle | 20 m/min |
| Distance Between Nozzle and Substrate | 30 mm |
| Repetition | 2 times |

After the CdTe film 44 is subjected to a flattening process as in the foregoing, a carbon paste is screen printed on the surface of the CdTe film 44 and then baked, which completes the manufacturing process of C electrodes 45. Further, an Ag paste is screen printed on the surface of the CdTe film 44 and the C electrodes 45 and then baked to form Ag electrodes 46. The C electrodes 45 and the Ag electrodes 46 serve as upper electrodes.

As in the foregoing, the introduction of the method of flattening a surface of a semiconductor film in accordance with the present example in a manufacturing process of photovoltaic cells enables flattening of the irregular surface of the CdTe film 44 by reducing differences in elevation level between the concave and convex portions of the irregular surface to about lam, while retaining the diameters of the polycrystalline particles in the CdTe semiconductor film 44 at several $\mu$m.

This enables fine patterning to be performed in the formation of the C electrodes 45 and the Ag electrodes 46, i.e., the upper electrodes, on the CdTe film 44, and enables photovoltaic cells to be manufactured with satisfactory performance and reliability.

Further, since the method of flattening a surface of a semiconductor film is simple, it is suitably applicable to a semiconductor film having a large surface area. Therefore, the present method is applicable to manufacture of a photovoltaic cell on a glass substrate having a large surface area.

The method of flattening a surface of a semiconductor film in accordance with the present example is by no means limited to the aforementioned embodiment and examples, and as previously explained in DESCRIPTION OF THE EMBODIMENT, can be used to flatten the surface of a semiconductor film with combination with conventional grinding techniques.

The method of flattening a surface of a semiconductor film in accordance with the present invention is by no means limited in its applicability to manufacture of two-dimensional image detectors and photovoltaic cells described in the first and second examples respectively, and are applicable in any field where a process is required to flatten the surface of a semiconductor film with irregularities of the micron level. For example, the method in accordance with the present invention can be applied to the manufacture of infrared ray sensors. Further, the material constituting the semiconductor film is by no means limited to CdTe and CdZnTe above: the semiconductor film may alternatively be composed of, for example, group II–VI compound semiconductors, group III–V compound semiconductors, and group IV semiconductors. Among these semiconductors, the surface of a polycrystalline semiconductor film is extremely effectively flattened by the method of flattening a surface of a semiconductor film in accordance with the present invention.

As in the foregoing, the method of flattening a surface of a semiconductor film in accordance with the present invention may be such that the irregular surface of a semiconductor film is bombarded with ceramic particles.

According to the method, ceramic particles bombarding the irregular surface of a semiconductor film smooth the irregularities of the surface of the semiconductor film, which enhances the flatness of the surface.

Typically, the method of bombarding the object, i.e., the substrate, with ceramic particles is employed for the formation of irregularities on the surface of the substrate in a random manner, i.e., for the formation of a satin finished surface. In the present invention, the method is used for the opposite purpose: an irregular surface of a semiconductor film is bombarded with ceramic particles so as to smooth the irregularities of the surface of the semiconductor film, thereby enhancing the flatness of the surface. Besides, the method of flattening a surface of a semiconductor film in accordance with the present invention is very simple, for nothing is required other than bombarding with ceramic particles.

The method, therefore, is capable of readily giving a high degree of flatness to an irregular surface of the semiconductor film, and still requires only a simple device. The method is further capable of readily flattening the surface of a large semiconductor film.

Here, the "ceramic particles" refer collectively to non-metal particles composed of a solid.

The method of flattening a surface of a semiconductor film in accordance with the present invention may be such that the ceramic particles have diameters in a range of from #1000 to #4000.

According to the method, the ceramic particles bombarding a surface of a semiconductor film have diameters in a range of #1000 to #4000. The use of ceramic particles with diameters in this range best reduces differences in elevation level between the concave and convex portions of an irregular surface of a semiconductor film, if the differences are about several $\mu$m.

Thus, the method in accordance with the present invention efficiently flattens an irregular surface of a semiconductor film, when the differences in elevation level between the concave and convex portions of the irregular surface are about several $\mu$m.

Incidentally, the sign, "#", represents a unit expressing sizes of meshes by means of the number of perforations per inch.

The method of flattening a surface of a semiconductor film in accordance with the present invention may be such that the semiconductor film is a polycrystalline film composed of CdTe or CdZnTe.

According to the method, the semiconductor film with an irregular surface is a polycrystalline film composed of CdTe or CdZnTe. Polycrystalline films composed of CdTe or CdZnTe are highly sensitive to x-rays and other radiation, and therefore applicable to, for example, radiation detector elements such as two-dimensional image detectors. CdTe has another use as a material for light detector elements, such as highly efficient thin film photovoltaic cells. The method in accordance with the present invention therefore is capable of flattening the semiconductor film used in such radiation or light detector elements, and enables an ideal junction to be established between the semiconductor film and a layer formed thereon. The method is further capable of facilitating fine fabrication of a layer formed on the semiconductor film.

Thus, the method enables manufacture of radiation detector elements with satisfactory performance and reliability with excellent sensitivity to radiation and also manufacture of highly efficient light detector elements.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A method of flattening a surface of a semiconductor film, comprising:

bombarding an irregular surface of a semiconductor film with abrasive particles so as to grind the irregular surface; and wherein the abrasive particles have a higher hardness than the semiconductor film.

2. The method as defined in claim 1, wherein the abrasive particles comprise a non-metal solid.

3. The method as defined in claim 1, wherein the irregular surface is bombarded with the abrasive particles that are in a liquid-dispersed state.

4. The method of claim 1, wherein the semiconductor film comprises a polycrystalline semiconductor film.

5. The method of claim 1, wherein the semiconductor film comprises at least one of CdTe and CdZnTe.

6. A method of flattening a surface of a semiconductor film, comprising:

bombarding an irregular surface of a semiconductor film with abrasive particles so as to grind the irregular surface; and wherein the irregular surface is ground in advance using particles having diameters larger than those of the abrasive particles.

7. The method of claim 6, wherein the semiconductor film comprises a polycrystalline semiconductor film.

8. The method of claim 6, wherein the semiconductor film comprises at least one of CdTe and CdZnTe.

9. A method of flattening a surface of a semiconductor film, comprising the step of bombarding an irregular surface of a semiconductor film with ceramic particles.

10. The method as defined in claim 9, wherein the ceramic particles have diameters in a range of from #1000 to #4000.

11. The method as defined in claim 9 wherein the semiconductor film is a polydrystalline film composed of CdTe or CdZnTe.

12. The method of claim 9, wherein the semiconductor film comprises a polycrystalline semiconductor film.

13. The method of claim 9, wherein the semiconductor film comprises at least one of CdTe and CdZnTe.

* * * * *